US005247263A

United States Patent [19]

Purser

[11] Patent Number: 5,247,263

[45] Date of Patent: Sep. 21, 1993

[54] INJECTION SYSTEM FOR TANDEM ACCELERATORS

[75] Inventor: Kenneth H. Purser, Lexington, Mass.

[73] Assignee: High Voltage Engineering Europa B.V., Amersfoort, Netherlands

[21] Appl. No.: 695,941

[22] Filed: May 6, 1991

[51] Int. Cl.[5] ..... H01J 23/00

[52] U.S. Cl. ..... 328/233; 313/360.1

[58] Field of Search ..... 328/233; 313/360.1

[56] References Cited

U.S. PATENT DOCUMENTS 2,736,809 2/1956 Bacon ..... 313/360.1

3,353,107 11/1967 van de Graaff ..... 328/233

3,423,684 1/1969 Purser ..... 328/233

3,731,211 5/1973 Purser ..... 328/233

*Primary Examiner*—Donald J. Yusko

*Assistant Examiner*—John E. Giust

*Attorney, Agent, or Firm*—Nields & Lemack

[57] ABSTRACT

An injection system for a tandem accelerator with equal transmission efficiency over a broad energy range includes means for shielding the injected ion beam from the electric field within the grounded end of the low-energy acceleration tube and injecting the ion beam into the low-energy acceleration tube sequentially through a narrow acceleration gap and the shielded region.

6 Claims, 3 Drawing Sheets

INJECTION SYSTEM FOR TANDEM ACCELERATORS

BACKGROUND OF THE INVENTION

1. Field of the Invention

This invention relates to tandem accelerators, wherein a high-voltage terminal is used to accelerate charged particles towards the high-voltage terminal as well as from the high-voltage terminal by means of charge exchange phenomena within the high-voltage terminal.

2. Description of the prior Art

The basic optical arrangement of a tandem acceleration system is shown in FIG. 1. (The term "optical" is used herein in the context of charged-particle optics.) The system includes a tandem accelerator and an injector. The tandem accelerator includes a high voltage terminal, a voltage generator for maintaining a high positive voltage on the high voltage terminal, and acceleration tubes. A charge-particle stripper is mounted within the high voltage terminal together with a suitable gas supply to provide gas within the stripper. The operation of a tandem accelerator is well known and is disclosed, for example, in U.S. Pat. No. 3,353,107 to Van de Graaff and elsewhere. The injector includes a suitable negative ion source and a defining apertures. Negative ions from the source are focused and are then directed into the low-energy acceleration tubes. The focusing operation is such as to produce a waist at the high voltage terminal. A beam waist is desirable at the terminal so that the stripper diameter can be as small as possible and to minimize emittance increases due to small angle scattering.

The advantages of having the injection point at fixed location have been previously discussed in U.S. Pat. No. 3,423,684 by Kenneth H. Purser. Briefly, it is pointed out that it is often desirable to define properties of an ion beam including its momentum and energy and such definition is often achieved by dispersing the ions across a fixed aperture. In addition, beam monitors, such as Faraday cups and scanners, can often be most useful when these elements are located at a fixed beam waist.

GRIDDED INJECTION SCHEMES

Several injection systems have previously been used in tandem accelerator systems to achieve fixed point injection. One of these, described in the above U.S. Pat. No. 3,423,684, employs a grid structure at the ground end of the low-energy tube. This grid acts to terminate the electric field lines and eliminate the strong lens action at the entrance to the tube caused by curvature of the equipotentials.

A second procedure, described in detail in U.S. Pat. No. 3,731,211, also by Kenneth H. Purser, employs an independent gridded lens located close to the entrance of the acceleration tube. By taking advantage of the fact that gridded lenses can be defocusing, it is possible to compensate for the overfocusing which can be present at the entrance to an acceleration tube.

While both of the above systems work well, they suffer from the disadvantage that some beam is intercepted by the grid, thereby causing beam loss and gradual sputtering away of the grid material. In addition, when the grid is a terminator to the accelerating fields, high local fields can be present at the surface of the wires which may lead to field emission of electrons and subsequent production of unwanted X-radiation.

High Energy Injection

An alternative technique, which has been widely employed in the design of high energy implantation equipment, injects ions into a tandem at a sufficiently high energy that the focal length of the natural lens at the entrance to the low energy acceleration tube becomes very long. Under these conditions a separate lens, which is usually a quadrupole, doublet or singlet, is employed to produce the desired waist at the terminal. While effective for high current acceleration, this injection system is expensive because it usually involves elevating the ion source and all of its associated power supplies to an electrical potential which may be as high as several hundred keV.

Injection Goals

It is desirable to keep the ion source and the associated analysis and injection optics close to ground potential. One practical difficulty in achieving the desired beam envelope without using grids is that the acceleration tube inherently has strong optical properties and can thus over focus the ion beam so that it can become impossible to produce a focus at the terminal without introducing a second strong lens. The dominant contributor to this tube-lens effect arises from the natural bulging of the electrostatic equipotentials at the tube entrance; this bulging leads to a local lens action with a focal length given approximately by:

$$F_e = 4 \times V/E$$

ps

Here, $F_e$ is the focal length of the entrance lens, V is the acceleration potential through which the ions have passed before reaching the entrance lens, and E is the electric field gradient beyond the lens.

In those tandems which operate without shorting rods, the electric field, E, beyond the lens is linearly proportional to the terminal voltage so that at high terminal voltages the tube entrance lens can become very strong, causing the point conjugate to the terminal waist to be located close to the tube entrance. Thus, unless a crossover is introduced quite close to the tube entrance, the beam will tend to be over focused within the tube and it will not be possible to produce a waist in the terminal without additional lens elements. While for a specific terminal voltage this strong lens strength can be compensated by introducing a properly located second high-strength lens properly located with respect to the acceleration tube entrance, matching is only perfect for a single terminal voltage.

SUMMARY OF THE INVENTION

The present invention relates to an apparatus which overcomes the foregoing problems and includes a new injection apparatus for focusing the negative ions to a beam waist at the terminal. The feature of this invention is that it allows the necessary focusing to be achieved when the object point is at an accessible fixed location on the tandem axis substantially outside of the pressure vessel. An important feature is that this apparatus can operate over a wide range of terminal voltages without introducing significant changes in the linear magnification between the object point and the conjugate terminal crossover.

BRIEF DESCRIPTION OF THE DRAWINGS

The invention may best be understood from the following detailed description thereof, having reference to the accompanying drawings, in which.

DESCRIPTION OF THE PREFERRED EMBODIMENT

Figure 1:
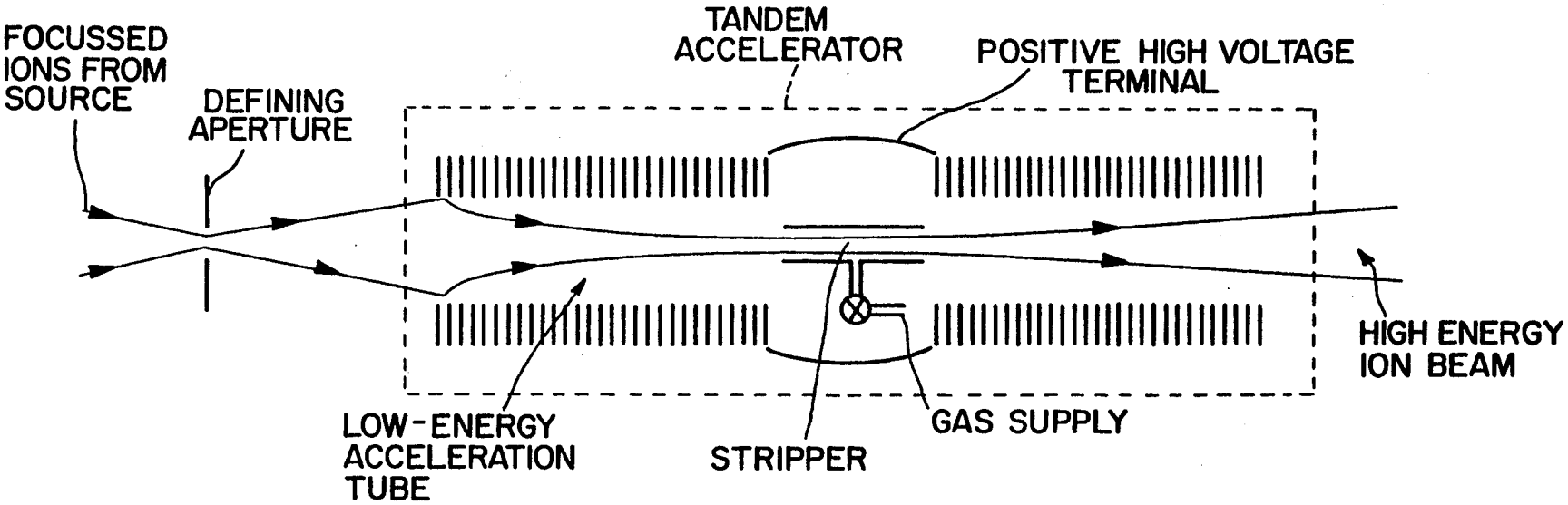
FIG. 1 PRIOR ART
FIG. 1 is a schematic illustration of the basic optical arrangement of a tandem acceleration system.
Figure 2:
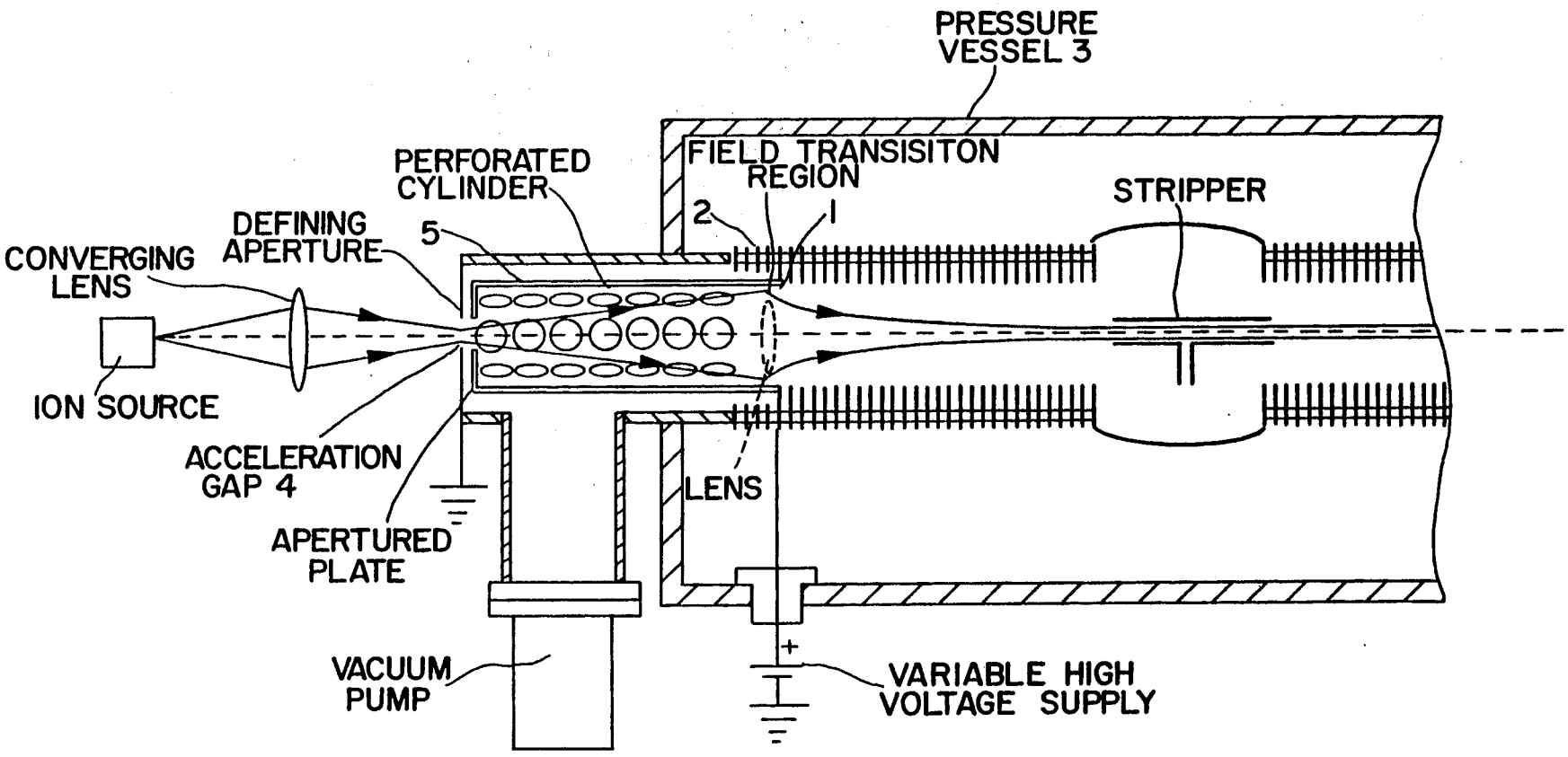
FIG. 2 is a schematic illustration of the apparatus of the invention.

The principles of the invention are shown in FIG. 2. Referring thereto, the tandem accelerator system therein shown is basically the same as that shown in FIG. 1. Thus, ions from a negative ion source are focused by an appropriate converging lens so as to pass through a defining aperture and then travel successively through a low-energy acceleration tube, a stripper, and a high energy acceleration tube. Each acceleration tube includes a multiplicity of alternating insulator rings and apertured electrode disks. The high voltage is equally divided among the electrode disks so that a substantially constant electric field is maintained within each acceleration tube over most of its length. Thus, the electrode disk at the extreme left in FIG. 2 is at ground potential, and as one moves in sequence to the right each successive electrode disk is at a higher potential, and the difference in potential between successive disks is substantially constant. The modification introduced by the invention occurs at the entrance to the low-energy acceleration tube and involves controlling the electric field traversed by the negative ions as they travel from the defining aperture towards the main accelerating electric field within the low-energy acceleration tube. In accordance with the invention, a perforated cylinder is supported at the entrance to the low-energy acceleration tube and is electrically connected to an electrode disk which is above ground potential by an amount equal to several times the potential difference between successive disks. The voltage of the electrode disks and hence of the cylinder is controlled by a variable voltage supply. The end of the cylinder which is remote from this electrode disk is provided with an apertured plate which is located near the grounded defining aperture, thereby creating an electric field between the defining aperture and the end of the cylinder. The negative ions are accelerated somewhat as they traverse this gap, and they then "coast" at constant velocity through the interior of the cylinder, which is field-free. Upon leaving the cylinder, the negative ions pass through a focusing electric field: i.e. a charged-particle lens.

It can be seen that the first active tube section (1) is insulated from the ground plane by one or several insulators (2) within the pressure vessel (3) allowing the first active section to be elevated to potentials of 100 kV or more. At the first active tube section (1) there is a transition from a region with zero electric fields to one, well inside of the acceleration tube, where the accelerating fields are uniform and along the axis. The transition between these two regions results in strongly bulging electrostatic equipotentials which produces a converging field shape. By controlling the strength of this lens it is possible to vary the focusing properties and direct the particles through the stripper canal at the terminal.

The strength of this lens at location (1) will increase with the terminal voltage if the energy of the ions entering the tube is kept constant. To avoid this effect and allow the optics and magnification for the whole machine to remain stable over a broad energy range, the energy of the injected ions is modified in the region between the defining aperture and the apertured plate (4) so that when the particles arrive at the 1st active section (1) they always have an energy which is a constant fraction of the ultimate terminal energy and which is such as will provide correct focusing through the stripper.

In the present invention this ratio constraint is satisfied by using a perforated metal cylinder (5) (for good radial vacuum conductance), which electrically provides an equipotential enclosure and extends the potential of the 1st active tube section (1) to well beyond the outside of the pressure vessel. Here, a matching acceleration gap, driven by an external power supply, increases the energy of the ions from the source (typically in the range 20–30 keV) to the energy needed for proper optical matching (30–120 keV).

Using this apparatus it is possible to keep the location of the object point for the accelerator fixed at all times and close to the above defining aperture. In addition, because the acceleration takes place across a gap whose length is short compared to the system dimensions, the radial size of the ion beam changes little during acceleration across the gap (4) allowing the radial magnification between this point and the terminal to be invariant with terminal voltage; the diameter of the terminal waist does not change with terminal voltage.

The necessary matching acceleration can be achieved in a variety of ways clear to those skilled in the art. For example, referring to FIG. 3, it can be seen that the necessary acceleration can be produced by passing the ions through a series of equipotential cylinders maintained at suitable intermediate potentials. The fields between individual cylinders can be arranged to produce positive focusing effects which allow the accelerator tube to see a virtual object which may be upstream from the plane of the defining aperture. Space becomes available for the introduction into a field free region of a movable aperture plate and Faraday cup.

Figure 3:
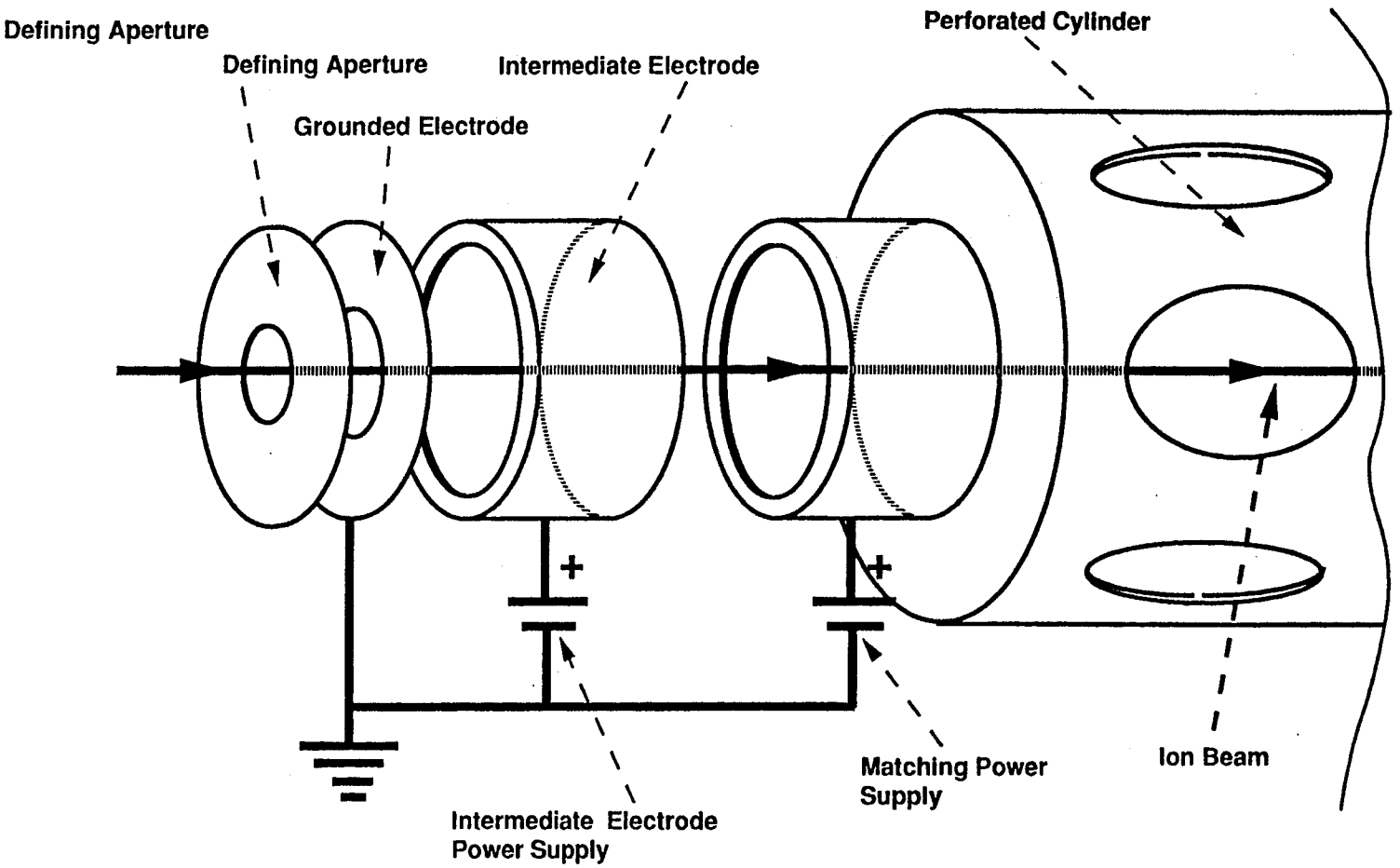
FIG. 3 is a diagram showing a detail of a portion of a modified version of the apparatus of FIG. 2.

The lens action at the entrance to a typical acceleration tube is shown in FIG. 3 of said U.S. Pat. No. 3,423,684. This lens action is also shown diagrammatically in FIG. 1 of the instant application. Usually the ion beam from the ion source is focused by an appropriate lens, and in FIG. 1 such focusing produces an "image" of the ion source at a defining aperture. This image then serves as the object upon which the aforementioned lens action operates, so as to produce an image of that object at the stripper within the positive high voltage terminal.

In the structure of the invention shown in FIG. 2, this lens action takes place within a short distance of the end of the low-energy acceleration tube, and the apparatus of the invention is added between said lens action and the grounded entrance to the accelerator. The focusing properties of the lens action are a function of the ratio between (1) the energy acquired by the charged particles between the lens action and the stripper and (2) the energy with which the charged particles enter the lens action. One object of the invention is to maintain this ratio constant. The energy acquired by the charged particles with which the charged particles enter the lens action is the sum of the energy with which the charged particles leave the ion source and the energy imparted to these particles by the acceleration gap. As an illustrative example, the charged particles might leave the ion source with an energy of 20 keV and acquire a further energy of 60 keV across the acceleration gap. If the voltage of the stripper is 3 megavolts, the ratio of the aforementioned energies is 3,000/80. If this ratio is to be maintained, then variations in the terminal voltage must be compensated by controlling the voltage across the acceleration gap; and this is done by the variable voltage supply.

In a representative embodiment, the ions from the ion source are focused by a suitable lens so as to form an image of the ion source at the acceleration gap. It is important that the acceleration gap be small, and by placing it at the crossover point of the focused ion beam, any lens action of the acceleration gap may be neglected. This image serves as the object for the tube-entrance lens action, and the image formed by such lens action should be located at or near the stripper. Moreover, the optical magnification between the acceleration gap and the stripper, introduced by this lens action should be small. In a representative embodiment, the length of the perforated cylinder is one-half meter and the distance between the lens action and the stripper is two meters.

Some important advantages of this injection arrangement are:

1. It eliminates the need for a substantial air-insulated ion source cage. All of the necessary high voltages operate within the pressure vessel or within the vacuum enclosure.

2. There is no need for telemetering information from a high voltage ion source enclosure to ground.

3. Many items such as high power insulation transformers and isolated motor alternators are no longer needed.

4. The ion source is close to ground potential allowing other equipment such as Secondary Ion Mass Spectrometers to be readily interfaced with the tandem.

Having thus described the principles of the invention, together with several illustrative embodiments thereof, it is to be understood that although specific terms are employed, they are used in a generic and descriptive sense, and not for purposes of limitation, the scope of the invention being set forth in the following claims.

I claim:

1. In a tandem accelerator system which includes a local ground potential and which comprises (1) a first acceleration tube including a plurality of insulted metallic planes with aligned holes such that ions can pass along the length of said acceleration tube, said acceleration tube connecting a region having an electrical potential close to that of local ground with a region that can be elevated to a high positive potential, (2) an electron stripper located at the said high positive potential consisting of a low-pressure volume of gas or a thin foil through which the ions must pass, and (3) a second acceleration tube similar in construction to said acceleration tube said second acceleration tube also connecting the said high voltage region and ground, the improvement which comprises insulators which allow that end of the first acceleration tube which end is nearest to ground to be elevated in electrical potential, a metallic tubular connection between that end of the first acceleration tube which end is nearest to ground and a point some distance away from the tandem accelerator, an acceleration gap consisting of two parallel plates with concentric holes one plate being connected to the local electrical ground potential and the second connected to said metallic tubular connection, and a voltage power supply which is connected to permit the above metallic tubular connection between the end of the first acceleration tube and one plate of the above acceleration gap to be elevated to a positive potential.

2. The tandem accelerator system of claim 1 where said acceleration gap is in the form of cylindrical electrodes.

3. The tandem accelerator system of claim 1 where said acceleration gap is in the form of multiple cylindrical electrodes.

4. The tandem accelerator system of claim 1 where said acceleration gap is in the form of multiple plane electrodes with aligned holes through which the ion can pass.

5. A tandem accelerator comprising in combination a tank containing insulating gas under pressure, a high voltage terminal within said tank, means for maintaining said terminal at a high positive voltage, a low energy acceleration tube connected between said terminal and ground, a high energy acceleration tube connected between said terminal and ground, a stripper within said terminal, said low energy acceleration tube including a multiplicity of alternating insulating rings and apertured electrode disks, means for creating a field-free region between an electrode disk having a potential above ground and a point outside said tank, and means for injecting negative ions into said field-free region across an acceleration gap.

6. Apparatus for the acceleration of charged particles, comprising in combination a high voltage terminal, means for maintaining said terminal at a high positive voltage, charge exchange means within said high voltage terminal, a uniform-field low-energy acceleration tube having a grounded end and comprising a multiplicity of alternating insulating rings and apertured electrode disks, means for injecting negative ions into said low-energy acceleration tube, said injection means including (a) means for shielding the injected ion beam from the electric field within said low-energy acceleration tube between an electrode disk near said grounded end and an acceleration gap outside said acceleration tube, (b) means for injecting ions into said acceleration gap, and (c) means for controlling the potential of said electrode disk so that the energy of the ions passing through said electrode disk is a substantially constant fraction of the voltage on said high voltage terminal.

* * * * *